US005730949A

United States Patent [19]

Romine

[11] Patent Number: 5,730,949

[45] Date of Patent: Mar. 24, 1998

[54] DIRECT PROCESS ROUTE TO ORGANOMETALLIC CONTAINING PITCHES FOR SPINNING INTO PITCH CARBON FIBERS

[75] Inventor: Hugh E. Romine, Ponca City, Okla.

[73] Assignee: Conoco Inc., Ponca City, Okla.

[21] Appl. No.: 533,248

[22] Filed: Jun. 4, 1990

[51] Int. Cl.[6] ..... D01F 9/12

[52] U.S. Cl. ..... 423/447.1; 208/40; 208/44

[58] Field of Search ..... 208/40, 44, 39; 423/447.1

[56] References Cited

U.S. PATENT DOCUMENTS

| | | | |
|---|---|---|---|
| 3,258,419 | 6/1966 | Hanson et al. | 208/44 |
| 3,385,915 | 5/1968 | Hamling | 264/5 |
| 4,042,486 | 8/1977 | Asano et al. | 208/44 |
| 4,219,404 | 8/1980 | Dickakian | 208/39 |
| 4,277,324 | 7/1981 | Greenwood | 208/45 |
| 4,402,928 | 9/1983 | Lewis et al. | 208/40 |
| 4,460,454 | 7/1984 | Iijima et al. | 208/40 |
| 4,460,455 | 7/1984 | Moriya et al. | 208/40 |
| 4,533,461 | 8/1985 | Izumi et al. | 208/40 |
| 4,554,148 | 11/1985 | Gomi et al. | 423/447.1 |
| 4,590,055 | 5/1986 | Yamada et al. | 208/44 |
| 4,600,496 | 7/1986 | Cheng et al. | 208/44 |
| 4,606,872 | 8/1986 | Watanabe | 208/40 |
| 4,704,333 | 11/1987 | Elkins et al. | 423/447.1 |
| 4,892,642 | 1/1990 | Romine | 208/39 |
| 4,921,539 | 5/1990 | Harlin et al. | 208/44 |

OTHER PUBLICATIONS

Vanadium Complexes and Porphyrins in Asphaltenes, Yen et al, Journal of the Institute of Petroleum, vol. 55, No. 542, Mar. 1969.

Study of Carbonaceious Mesophase Through the ESR Spectra of Vanadyl Chelates, Yamada et al, Fuel, 1978, vol. 57, Feb. 1979.

Influence of Organic Sulfur Compounds and Metals on Mesophase Formation, Oi et al, Carbon, vol. 16, pp. 445–452, Jan. 1978.

*Primary Examiner*—Ngoclan Mai

[57] ABSTRACT

An improved process is disclosed for producing a metals containing anisotropic pitch product suitable for carbon fiber manufacture. Soluble-aromatic, organometallic compounds are added to a carbonaceous feedstock substantially free of mesophase pitch and the resulting composition is heat soaked preferably with gas sparge to produce a metals containing mesophase pitch.

35 Claims, No Drawings

DIRECT PROCESS ROUTE TO ORGANOMETALLIC CONTAINING PITCHES FOR SPINNING INTO PITCH CARBON FIBERS

FIELD OF THE INVENTION

The present invention resides in an improved process for producing a soluble, aromatic organometallic compound containing mesophase pitch which is suitable for carbon fiber manufacture, more particularly, the invention relates to a process for making high strength carbon fibers which exhibit superior tensile strength, and modulus properties. The process comprises adding a soluble, aromatic-organometallic compound to a carbonaceous feedstock and heat treating said carbonaceous feedstock with gas sparge to produce a metals containing mesophase pitch. The resulting metals containing mesophase pitch is suitable for melt spinning into a fiber artifact.

THE PRIOR ART

Processes for producing mesophase pitch and/or carbon fibers are known and are currently practiced commercially.

U.S. Pat. No. 3,385,915, issued May 28, 1968, discloses a process for producing metal oxide fibers which consists of impregnating a preformed organic polymeric material with a metal. Cellulose and rayon are described as suitable organic polymeric materials.

U.S. Pat. No. 4,042,486, issued Aug. 16, 1977 relates to a process for converting pitch to a crystalloid which consists of coating solid amorphous pitch particles with a metal or metal salt prior to gas sparging and heat soaking to produce a mesophase pitch.

U.S. Pat. Nos. 4,460,454 and 4,460,455, both issued Jul. 17, 1989 disclose a process for producing a pitch which is suitable for use in preparing carbon fibers. A hydrogenation step in the process either reduces or removes sulfur, nitrogen, oxygen, metals and asphaltenes from petroleum heavy residual oil.

U.S. Pat. No. 4,554,148, issued Nov. 19, 1985 relates to a process for the preparation of carbon fibers which consists of subjecting a raw material oil to thermal cracking conditions to obtain a pitch product containing at least 5 weight percent mesophase. A substantially mesophase free pitch is obtained by removing mesophase of a particular particle size from the pitch product. The raw material oil is derived from a napthene base or intermediate base petroleum crude and contains metals.

U.S. Pat. No. 4,600,496, issued Jul. 15, 1986, discloses a process for converting pitch into mesophase in the presence of catalytically effective amounts of oxides, diketones, carboxylates and carbonyls of certain metals. The mesophase pitch obtained is described as suitable for use in the production of carbon fibers.

U.S. Pat. No. 4,704,333 relates to a process for the formation of carbon fibers produced from the pitch described in U.S. Pat. No. 4,600,496 above. The process consists of extruding said mesophase to form fibers, cooling the extruded fibers and subjecting the fibers to elevated temperature to carbonize said fibers.

As can readily be determined from the above references, there is an ongoing research effort to determine new and more advanced processes and methods of producing mesophase pitch and carbon fibers.

SUMMARY OF THE INVENTION

The present invention resides in a process for producing a metals containing mesophase pitch which is readily spinnable into carbon fibers. The process for producing the metals containing mesophase pitch herein comprises adding a soluble aromatic, organometallic compound to a graphitizable carbonaceous feedstock. Next, the metals containing feedstock is heat soaked preferably with gas sparge to produce a pitch product containing mesophase pitch. The resulting mesophase pitch contains from about 50 PPM to about 20,000 PPM of the metals from the soluble organometallic compound. Thereafter, the mesophase pitch is isolated from the pitch product. The metals containing mesophase pitch herein provides fibers having enhanced oxidative reactivity and enhanced tensile strength and modulus properties. Thus, the present invention provides for a metals containing, mesophase pitch which is readily spinnable into a carbon fiber.

DETAILED DESCRIPTION OF THE INVENTION

In accordance with the present invention a soluble aromatic, organometallic compound is added to a carbonaceous feedstock. The metals containing carbonaceous feedstock is heat soaked, preferably with gas sparge to produce a pitch product containing anisotropic pitch (mesophase pitch). The resulting mesophase pitch contains a substantial amount of the soluble aromatic, organometallic compound added to the carbonaceous feedstock.

It should be noted that some carbonaceous feedstocks may contain minor or trace amounts of metal compounds therein. Whenever this occurs, it is desirable to adjust the metal content of the carbonaceous feedstock to the desired concentration. This is accomplished by adding the soluble aromatic organometallic compounds herein to the carbonaceous feedstock thereby adjusting said metals content of the carbonaceous feedstock to the desired concentration.

The carbonaceous feedstocks used in the process of the invention are heavy aromatic petroleum fractions and coal-derived heavy hydrocarbon fractions, including preferably materials designated as pitches. All of the feedstocks employed are substantially free of mesophase pitch.

The term "pitch" as used herein means petroleum pitches, natural asphalt and heavy oil obtained as a by-product in the naphtha cracking industry, pitches of high carbon content obtained from petroleum asphalt and other substances having properties of pitches produced as by-products in various industrial production processes.

The term "petroleum pitch" refers to the residuum carbonaceous material obtained from the thermal and catalytic cracking of petroleum distillates or residues.

The term "anisotropic pitch or mesophase pitch" means pitch comprising molecules having an aromatic structure which through interaction have associated together to form optically ordered liquid crystals.

The term "isotropic pitch" means pitch comprising molecules which are not aligned in optically ordered liquid crystals. Fibers produced from such pitches are inferior in quality to fibers made from mesophase pitches.

Generally, feedstocks having a high degree of aromaticity are suitable for carrying out the present invention. Carbonaceous pitches having an aromatic carbon content of from abut 40 percent to about 90 percent as determined by nuclear magnetic resonance spectroscopy are particularly useful in the process. So, too are high boiling, highly aromatic streams containing such pitches or that are capable of being converted into such pitches.

On a weight basis, useful feedstocks will contain from about 88 percent to about 93 percent carbon and from about 9 percent to about 4 percent hydrogen. While elements other than carbon and hydrogen, such as sulfur and nitrogen, to mention a few, are normally present in such pitches, it is important that these other elements do not exceed about 5 percent by weight of the feedstock. Also, these useful feedstocks typically will have an average molecular weight of the order of about 200 to about 1,000.

In general, any petroleum or coal-derived heavy hydrocarbon fraction may be used as the carbonaceous feedstock in the process of this invention. Suitable feedstocks in addition to petroleum pitch include heavy aromatic petroleum streams, ethylene cracker tars, coal derivatives, petroleum thermal tars, fluid catalytic cracker residues, and aromatic distillates having a boiling range of from 650°–950° F. The use of petroleum pitch-type feed is preferred.

The soluble organometallic compounds of this invention may be either naturally occurring or synthetic organometallic compounds. It should be noted that the naturally occurring soluble organometallic compounds are preferred herein. The naturally occurring, soluble organometallic compounds of this invention are at least partially aromatic and exhibit good thermal stability when dissolved in aromatic hydrocarbons. Generally, they come from the family of organometallic complexes found in the asphaltic fraction of crude petroleum. The aromatic-organo constituent of the organometallic compounds herein include porphyrins and related macrocyclic compounds with altered porphin ring structures. They also include porphins with added aromatic rings and/or with sulfur and oxygen as well as nitrogen ligands. Preferred organometallic compounds are relatively thermally stable porphin type structures which are readily dissolved in the carbonaceous feedstocks herein. These compounds often have fused aryl substituents.

The metal constituent of the organometallic compounds herein is a metal or mixture of metals selected from the Groups IIA, IB, IIB, IVB, VB, VIB and VIII metals of the Periodic Table, with the Group VB and Group VIII metals being preferred.

Especially preferred metals from the above-described groups include vanadium, nickel, magnesium, zinc, iron, copper, irridium, manganese and titanium and mixtures thereof. It should be noted that while all of the metals herein are suitable for use in the invention, vanadium and nickel are highly preferred with vanadium being especially preferred.

Applicants do not wish to be bound by theory, however, it is believed that the metals described above complex with the aromatic-organo constituents of the organometallic compounds and form chelates which are substantially soluble in the carbonaceous feedstocks herein.

One source for naturally occurring soluble aromatic, organometallic compounds suitable for use in this invention is Mayan crude. The Mayan crude is concentrated into a concentrate which contains a substantial amount of soluble aromatic, organometallic compounds.

Representative examples of soluble synthetic, organometallic compounds suitable for use include 5, 10, 15, 20-tetraphenyl-21H, 23H-porphine vanadium (IV) oxide; 5, 10, 15, 20-tetraphenyl-21H, 23H-porphine nickel (11); 5, 10, 15, 20-tetraphenyl-21H, 23H-porphine zinc; 5, 10, 15, 20-tetraphenyl-21H, 23H porphine-cobalt (11) and 5, 10, 15, 20-tetraphenyl-21H, 23H-porphine copper and mixtures thereof. The synthetic vanadium organometallic compound is especially preferred. These synthetic organometallic compounds are manufactured and sold commercially by the Aldrich Chemical Company, located in Milwaukee, Wis.

The herein described organometallic compounds, including both naturally occurring and synthetic organometallic compounds can be incorporated in the carbonaceous feedstock in any convenient manner. Thus, the organometallic compounds can be added directly to the carbonaceous feedstock by dissolving the desired organometallic compound in the carbonaceous feedstock at the desired level of concentration. Normally, the organometallic compound is added to the carbonaceous feedstock in a sufficient amount to impart a metals concentration in mesophase pitch produced from the carbonaceous feedstock of from about 50 PPM to about 20,000 PPM.

Alternatively, the organometallic compounds herein may be blended with suitable solvents to form an organometallic compound-solvent mixture that can be readily dissolved in the appropriate carbonaceous feedstock at the desired concentration. If an organometallic compound-solvent mixture is employed, it normally will contain a ratio of organometallic compound to solvent of from about 0.05:20, to about 0.15:10 respectively.

Solvents suitable for use in forming the concentrates herein include, petroleum based compounds, for example, gas oils, benzene, xylene and toluene and mixtures thereof. The particular solvent selected should, of course, be selected so as not to adversely affect the other desired properties of the ultimate carbonaceous feedstock composition.

The soluble aromatic, organometallic compounds are added to a carbonaceous feedstock and the metals containing feedstock is subjected to a heat soak process, preferably with gas sparge to produce a pitch product containing mesophase pitch. The organometallic compound is added to the carbonaceous feedstock at a concentration sufficient to impart from about 50 PPM to about 20,000 PPM, especially from about 80 PPM to about 1,000 PPM, preferably from about 100 PPM to about 500 PPM of the metals from the organometallic compound in the mesophase pitch after the heat soak process.

Conversion of the metals containing feedstock to mesophase pitch is effected by subjecting the feedstock in a molten state to elevated temperatures, usually at atmospheric pressure with agitation and with gas sparging. The gas continuously passes through the metals containing feedstock during the sparge for maximum contact and conversion of the feedstock to a metals containing mesophase pitch.

The heat soak process conditions employed are well known in the art and include temperatures in the range of from about 350° C. to about 500° C., preferably from about 370° C. to abut 425° C.; at a pressure of from about 0.1 atmospheres to about 1 or 3 atmospheres. However, higher pressures may be used if desired. The gas sparging time period may vary widely depending upon the carbonaceous feedstock, gas feed rate, temperature, etc.

Normally, the heating and/or gas sparging steps are conducted over a time period of from about 2 to about 100 hours, especially from about 2 to about 60 hours, preferably from about 2 to about 30 hours. The sparging gas is usually contacted with the carbonaceous feedstock at a rate of from about 1 to about 20 SCF of gas per pound of feedstock per hour.

The sparging gas employed may be an inert gas, an oxidative reactive gas, or an inert gas-oxidative reactive gas mixture. Suitable inert gases include nitrogen, argon, xenon, helium, methane, hydrocarbon based flue gas and steam and mixtures thereof, with nitrogen being the preferred inert gas. Oxidative reactive gases which can be used herein are air, oxygen, ozone, hydrogen peroxide, nitrogen dioxide, formic acid vapor and hydrogen chloride vapor and mixtures thereof. Oxygen is the preferred oxidative reactive gas. When a nitrogen gas-oxygen gas mixture is used in the process, oxygen preferably comprises from about 0.05 to about 5 percent of the gas mixture.

Generally the pitch production is greater than 70% mesophase and suitable for spinning into carbon fibers. If, however, the produced pitch has a lower mesophase content than desired, the pitch can be separated by means such as gravity separation, as taught in the art, to produce a mesophase pitch containing up to 100% mesophase and suitable for spinning.

The mesophase pitch of this invention contains from about 50 PPM to about 20,000 PPM metals from the soluble aromatic, organometallic compound which was added to the carbonaceous feedstock and may be spun into anisotropic carbon fibers by conventional procedures such as melt spinning, centrifugal spinning, blow spinning and the like.

The following examples serve to demonstrate the best mode of how to practice the invention herein and should not be construed as a limitation thereof.

EXAMPLE I

A vanadium containing mesophase pitch was prepared by sparge heat soaking an aromatic residue containing added vanadium porphyrin in accordance with the following procedure:

Mid-Continent refinery decant oil was topped to produce an 850° F.+residue. This residue was mixed with 0.05 percent 5, 10, 15, 20-tetraphenyl-21H, 23H-porphine vanadium (IV) oxide and 10 percent toluene cosolvent. The toluene was distilled from the mixture and the residue was heat soaked 32 hours at 385° C. Nitrogen was bubbled through the heat soak unit at a rate of 4 SCF nitrogen gas per hour per pound of feedstock during the heat soak. Residue product yield was 19.6 percent. It should be noted that some of the feed was lost during start up of the gas sparge which resulted in a lower yield of residue product as compared to Examples I and II. The product tested 100 percent mesophase pitch, melting at 300° C. as determined by hot stage microscopy. When ashed, this pitch product yielded 190 PPM residue which tested greater than 90 percent vanadium oxides as analyzed by emission spectroscopy.

The vanadium containing mesophase pitch was melt spun into carbon fibers with very good spinnability at 335° C. The stabilized, carbonized fibers tested 425 Mpsi tensile strength and 38 MMpsi tensile modulus.

EXAMPLE II

A vanadium containing mesophase pitch was prepared by sparge heat soaking an aromatic residue containing added vanadium porphyrin in accordance with the following procedure:

Mid-Continent refinery decant oil was topped to produce an 850° F.+residue. This residue was mixed with 0.15 percent 5, 10, 15, 20-tetrophenyl-21H, 23H-porphine vanadium (IV) oxide and 10 percent toluene cosolvent. The toluene was distilled from the mixture and the residue was heat soaked 32 hours at 385° C. Nitrogen was bubbled through the heat soak unit at a rate of 4 SCF nitrogen gas per hour per pound of feedstock during the heat soak. Residue product yield was 23.9 percent. The product tested 100 percent mesophase pitch melting at 320° C. When ashed, this pitch product yielded 644 PPM residue which tested greater than 90 percent vanadium oxides as analyzed by emission spectroscopy.

The vanadium containing mesophase pitch was melt spun into carbon fibers with fair spinnability at 320° C. The stabilized, carbonized fibers tested 380 Mpsi tensile strength and 45 MMpsi tensile modulus. Oxidative DSC was run on the as-spin fiber. A level of oxidation corresponding to stabiliation was reached 13% sooner with this fiber compared to the control fiber of Example III.

EXAMPLE III

A metals free mesophase pitch was prepared in accordance with the procedure set forth in Example I with the following exception:

The vanadium porphyrin compound, 5, 10, 15 20-tetraphenyl-21H, 23H-porphine, was not added to the 850° F.+decant oil.

A 23.0 percent yield of residual product resulted. This product tested 100 percent mesophase which melted at 300° C. as determined by hot stage microscopy. The ash content of the pitch tested less than 5 PPM. The pitch showed good spinnability when spun into carbon fibers at 320° C. The stabilized, carbonized fibers tested 390 Mpsi tensile strength and 36 MMpsi tensile modulus.

Table I below sets forth the process conditions and results of the tests conducted in Examples I to III.

TABLE 1

| Feed | Ex. I Decant Oil 850° F.+ and 0.05% TPVP[1] | Ex. II Decant Oil 850° F.+ and 0.15% TPVP[1] | Ex. III Decant Oil 850° F.+ and Control |
|---|---|---|---|
| Sparge Preparation | | | |
| Time, Hr. | 32 | 32 | 32 |
| Temp., °C. | 385 | 385 | 385 |
| $N_2$ Rate, SCF/Hr.-lb. Feed | 4 | 4 | 4 |
| Mesophase Yield, Wt. % | 19.6[2] | 23.9 | 23.0 |
| Mesophase Properties | | | |
| Hot Stage, % Mesophase | 100 | 100 | 100 |
| Hot Stage Melt temp., °C. | 300 | 320 | 300 |
| Ash, PPM | 190 | 644 | <5 |
| Spinning Results | | | |
| Spin Temp., °C. | 335 | 360 | 320 |
| Attenuation | very good | fair | good |
| Tensile Strength, Mpsi | 425 | 380 | 390 |
| Elongation, % | .91 | .70 | .93 |
| Tensile Modulus, MMpsi | 38 | 45 | 36 |

[1]TPVP = 5, 10, 15, 20 — tetraphenyl — 21H, 23H — porphine vanadium oxide

[2]Some feed was lost during start-up of sparge which resulted in a lower yield of mesophase As can readily be determined from the above test results, the metals containing mesophase pitches produced according to the procedure set forth herein resulted in a carbon fiber with superior or comparable properties when compared to the control mesophase pitch.

Obviously, many modifications and variations of the invention, as herein above set forth, can be made without departing from the spirit and scope thereof, and therefore only such limitations should be imposed as are indicated in the appended claims.

I claim:

1. A process for producing a soluble metals containing mesophase pitch which comprises:

(a) adding a soluble aromatic, organometallic compound to a graphitizable carbonaceous feedstock, (b) gas sparge heat soaking the metals containing carbonaceous feedstock from step (a) to produce a pitch product containing mesophase; and (c) isolating mesophase pitch containing from about 50 PPM to about 20,000 PPM of the metals from the soluble organometallic compound.

2. The process according to claim 1, wherein the metals from the soluble organometallic compound of step (a) are selected from vanadium, nickel, magnesium, zinc, iron, copper, irridium, manganese and titanium and mixtures thereof.

3. The process according to claim 1, wherein the metals from the soluble organometallic compound of step (a) are vanadium and nickel.

4. The process according to claim 1, wherein the metal from the soluble organometallic compound of step (a) is vanadium.

5. The process according to claim 1, wherein the soluble organometallic compound of step (a) is a metalloporphyrin.

6. The process according to claim 1, wherein the aromatic-organo constituent of the organometallic compound comprises porphyrins, macrocyclics with altered porphin ring structures, porphins with added aromatic rings, porphins with sulfur, oxygen and nitrogen ligands and porphins with fused aryl substituents.

7. The process according to claim 6, wherein the soluble organometallic compound of step (a) is a naturally occurring metalloporphyrin.

8. The process according to claim 1, wherein the soluble organometallic compound of step (a) is a synthetic organometallic compound.

9. The process according to claim 8, wherein the soluble synthetic, organometallic compound is 5, 10, 15, 20-tetrophenyl-21H, 23H-porphine vanadium (IV) oxide.

10. The process according to claim 1, wherein the mesophase pitch of step (c) contains from about 80 PPM to about 1,000 PPM of the metals from the organometallic compound.

11. The process according to claim 1, wherein the mesophase pitch of step (c) contains from about 100 PPM to about 500 PPM of the metals from the organometallic compound.

12. The process of claim 1, wherein the metal containing, graphitizable carbonaceous feedstock is gas sparged with an inert gas during the heat soak step.

13. The process of claim 12, wherein the inert gas is nitrogen.

14. The process of claim 1, wherein the metals containing, graphitizable carbonaceous feedstock is gas sparged with an inert gas-oxidative reactive gas mixture.

15. The process of claim 14, wherein the oxidative reactive gas comprises from about 0.05 percent to about 5 percent of the gas mixture.

16. The process of claim 14, wherein the oxidative reactive gas is oxygen.

17. The process according to claim 1, including adjusting the soluble aromatic, organometallic compound in the graphitizable carbonaceous feedstock of step (a) to a concentration sufficient to incorporate from about 50 PPM to about 20,000 PPM of the metals from the organometallic compound in the mesophase pitch after the gas sparge heat soak of step (b).

18. A process for producing a graphitizable carbon fiber from a metals containing mesophase pitch which comprises:

(a) adding a soluble aromatic, organometallic compound to a graphitizable carbonaceous feedstock, (b) gas sparge heat soaking the metals containing carbonaceous feedstock from step (a) to produce a pitch product containing mesophase pitch, (c) isolating mesophase pitch containing from about 50 PPM to about 20,000 PPM of the metals from the soluble organometallic compound, (d) melt spinning the metals containing mesophase pitch of step (c) to produce metals containing mesophase pitch fibers, (e) stabilizing the metals containing pitch fibers by oxidation; and (f) carbonizing the metals containing pitch fibers to produce carbon fibers.

19. The process according to claim 18, wherein the metals from the soluble organometallic compound of step (a) are vanadium, nickel, magnesium, zinc, iron, copper, irridium, manganese and titanium and mixtures thereof.

20. The process according to claim 18, wherein the metals from the soluble organometallic compound of step (a) are vanadium and nickel.

21. The process according to claim 18, wherein the metal of the soluble organometallic compound of step (a) is vanadium.

22. The process according to claim 18, wherein the soluble organometallic compound of step (a) is a metalloporphyrin.

23. The process according to claim 18, wherein the aromatic-organo constituent of the organometallic compound comprises porphyrins, macrocyclic with altered porphin ring structures, porphins with added aromatic rings, porphins with sulfur, oxygen and nitrogen ligands and porphins with fused aryl substituents.

24. The process according to claim 18, wherein the soluble organometallic compound of step (a) is a naturally occurring metalloporphyrin.

25. The process according to claim 18, wherein the soluble organometallic compound of step (a) is a soluble synthetic, organometallic compound.

26. The process according to claim 25, wherein the soluble synthetic, organometallic compound is 5, 10, 15, 20-tetraphenyl-21H, 23H-porphine vanadium (IV) oxide.

27. The process according to claim 18, wherein the mesophase pitch of step (c) contains from about 80 PPM to about 1,000 PPM of the metals from the organometallic compound.

28. The process according to claim 18, wherein the mesophase pitch of step (a) contains from about 100 PPM to about 500 PPM of the metals from the organometallic compound.

29. The process of claim 18, wherein the metals containing, graphitizable carbonaceous feedstock is gas sparged with an inert gas during the heat soak step.

30. The process of claim 18, wherein the inert gas is nitrogen.

31. The process of claim 18, wherein the metals containing, graphitizable carbonaceous feedstock is gas sparged with an inert gas-oxidative reactive gas mixture.

32. The process of claim 31, wherein the oxidative gas comprises from about 0.05 percent to about 5 percent of the gas mixture.

33. The process of claim 31, wherein the oxidative reactive gas is oxygen.

34. The process of claim 18, wherein the carbon fibers of step (f) are graphittzed to produce a graphttized carbon fiber.

35. The process according to claim 18, including adjusting the soluble aromatic, organometallic compound in the graphitizable carbonaceous feedstock of step (a) to a concentration sufficient to incorporate from about 50 PPM to about 20,000 PPM of the metals from the organometallic compound in the mesophase pitch after the gas sparge heat soak of step (b).

* * * * *